US005188577A

United States Patent [19]

Young et al.

[11] Patent Number: 5,188,577

[45] Date of Patent: Feb. 23, 1993

[54] APPARATUS FOR TOTAL BODY EXERCISE

[76] Inventors: Gary B. Young, 148 N. 3rd West; Jack N. Young, 497 Oak Crest Dr.; Steven R. Young, 249 N. 1st West; Franklin E. Young, 1149 N. Main, all of Monticello, Utah 84535

[21] Appl. No.: 913,607

[22] Filed: Jul. 13, 1992

[51] Int. Cl.[5] ..... A63B 22/04

[52] U.S. Cl. ..... 482/53; 482/93

[58] Field of Search ..... 482/52, 53, 79, 51, 482/70, 71, 80, 92, 93, 97

[56] References Cited

U.S. PATENT DOCUMENTS

| | | | |
|---|---|---|---|
| 4,337,939 | 7/1982 | Hoyle et al. | 482/79 |
| 4,838,543 | 6/1989 | Armstrong et al. | 482/53 |
| 5,060,935 | 10/1991 | Duhn et al. | 482/53 |
| 5,071,115 | 12/1991 | Welch | 482/53 |

*Primary Examiner*—Stephen R. Crow
*Attorney, Agent, or Firm*—K. S. Cornaby

[57] ABSTRACT

An exercising apparatus for full body exercise has a base member adapted to rest upon a floor and a support frame extending upwardly therefrom. The support frame has a pair of foot pedals pivotally attached thereto about midway of each foot pedal. A cross member attached to the upper end of the support frame has a pair of independently articulated pivotal arm handles rotatably attached to the cross-member. A pair of adjustable compressed spring tension devices are attached between each foot pedal and the upper cross member. A pair of actuating rods are pivotally attached respectively between each foot pedal and each arm handle, so that movement of either the arm handle or the foot pedal actuates the other member. Each of the two foot pedal-arm handle combinations is independently actuated, and not dependent on the other for movement. The foot pedals have pegs attached to the rearward ends to accommodate free weights; and the foot pedals have a solid member to tie the foot pedals together, as desired, to actuate both pedals together.

8 Claims, 4 Drawing Sheets

APPARATUS FOR TOTAL BODY EXERCISE

BACKGROUND OF THE INVENTION

This invention relates to an exercise apparatus for exercising the total body.

It has long been known that physical exercise has a beneficial effect on the human body. To this end, those who promote good health have advocated some form of physical exercise to maintain the organs and muscles of the body in a healthy condition.

In most cases, walking, jogging or bicycling provides stimulating exercise for the limbs and vital organs, particularly the heart and lungs. However, as the pace of life for many persons, especially those who tend to have indoor, high stress lifestyles, has increased, the time demands of such lifestyles has not allowed these individuals the luxury of open-air jogging or running. Moreover, in some cases, physicians have discovered that the constant pounding associated with jogging or running has caused damage to knees, ankles, feet and hips. Also, while running and jogging exercises the legs, heart and lungs, the arms assume a passive role in such exercise. That is, the arms move forward and backward as a person walks or runs, but do not perform work or exercise against a positive resistance.

As the public has become aware of the limitations of walking and running as a convenient form of exercise, various types of exercising apparatus have been developed, in many cases being modeled after the training methods used by body building enthusiasts for developing muscle tone for a variety of body muscles. Such apparatus were designed to take into account that most users had limited time and opportunity for out-door exercising, and desired the convenience of exercising in the home or at an indoor location near the work place.

A number of exercise machines have been developed to provide specific exercise for certain body organs and muscles. For example, stationary exercise bicycles exercise the legs, heart and lungs. Stationary treadmills exercise similar muscles and organs; while stationary rowing machines enable the user to exercise the upper torso, especially the arms and shoulders. So-called stair-climbing devices were developed to provide exercise for the legs, heart and lungs. As illustrated in U.S. Pat. Nos. 4,838,543 and 4,685,666, devices generally called for a support bar for the arms and hands to steady the user, while the legs were exercised by an alternative pumping or stair-climbing motion on reciprocating pedals designed to simulate the climbing of stairs. This action also provided excellent heart and lung exercise.

As the concept of a stair-climbing device began to be refined, the stationary support bar for arms and hands gave way to reciprocating handle bars movingly attached to the foot pedals of the stair-climbing apparatus. Such a device is disclosed in U.S. Pat. No. 4,830,362 wherein a tracker-action connection between the reciprocating pedals of the stair-climbing device induced a reciprocating movement in a pair of vertically-oriented handles to provide passive tracking exercise for the arms. That is, the positive reciprocating action of the foot pedals by the user resulted in a following or tracking action in the arm handles. The user could optionally hold onto the reciprocating arm handles for passive exercise, or could manipulate the foot pedals without holding onto the handles for leg exercise alone.

A further refinement of the stair-climbing art was developed to provide positive resistance to exercise the arms in a manner similar to the legs, which resulted in U.S. Pat. No. 4,989,858. The teaching of this patent provided for adjustment of the resistance to the arm handles by varying the resistance built into the shock absorbers.

It was therefore an objective of this invention to provide an exercise apparatus which has a wide range of resistance variability.

It was also an objective to provide an apparatus capable of providing exercise options for the whole body, including heart and lung exercise.

It was a further objective to provide an apparatus utilizing free weights.

SUMMARY OF THE INVENTION

The objectives of this invention are met by a universal exercising apparatus having a floor support base member to which is attached an adjustable upright vertical support frame. The support frame has means for movably attaching foot pedals which extend therefrom along the base member. A pair of vertically oriented rods are attached at respective first ends thereof to the respective foot pedals. The opposite respective ends of the vertical rods are attached to respective arm handles, so that as each foot pedal is reciprocated, the corresponding arm handle moves. The movement of the opposite pedal in a downward direction does not move the opposite pedal upwardly. That upward movement is only accomplished by the positive movement of the corresponding arm handle, thereby providing positive resistance for the arms and the legs. The foot pedals are provided with attaching means to connect the foot pedals together at the forward ends respectively thereof. Foot pad means are provided to extend forward of the apparatus along the support bar member. Means are also provided for attaching free weights to the rearward ends of the foot pedals.

THE DRAWING

A preferred embodiment of this invention is illustrated in the accompanying drawing, in which:

FIG. 1 is a perspective view of the exercise apparatus;

FIG. 2, a side elevational view of the apparatus shown in FIG. 1;

FIG. 3, an end elevational view of the apparatus shown in FIG. 1;

FIG. 4, a perspective view of an alternate embodiment;

FIG. 5, a perspective view of a further preferred embodiment;

FIG. 6, an end elevational view of still another embodiment; and

FIG. 7, a sectional perspective view of the exercise apparatus showing the attachment of shock absorbers to the foot pedals.

DETAILED DESCRIPTION OF THE ILLUSTRATED EMBODIMENTS

Figure 1:
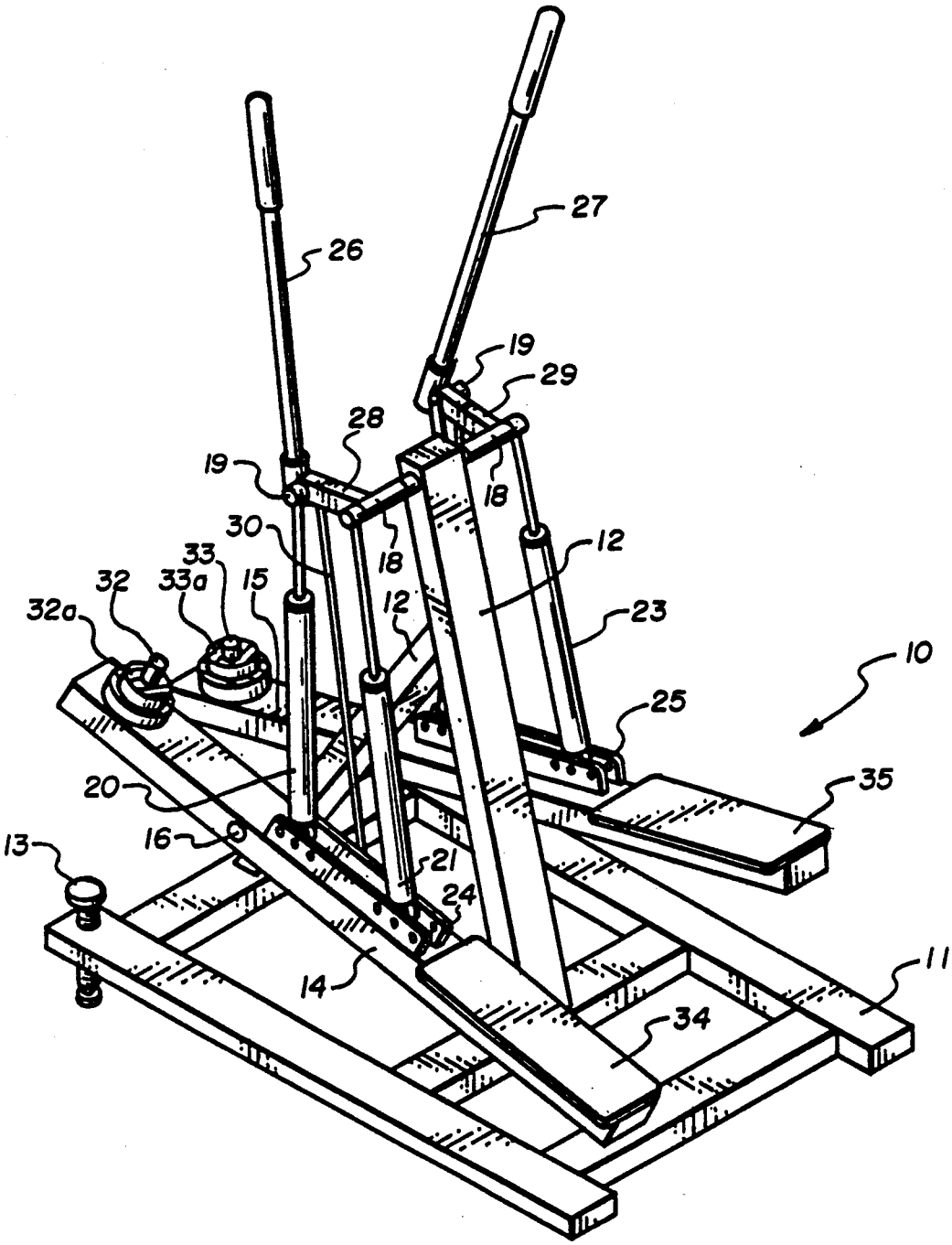
Figure 3:
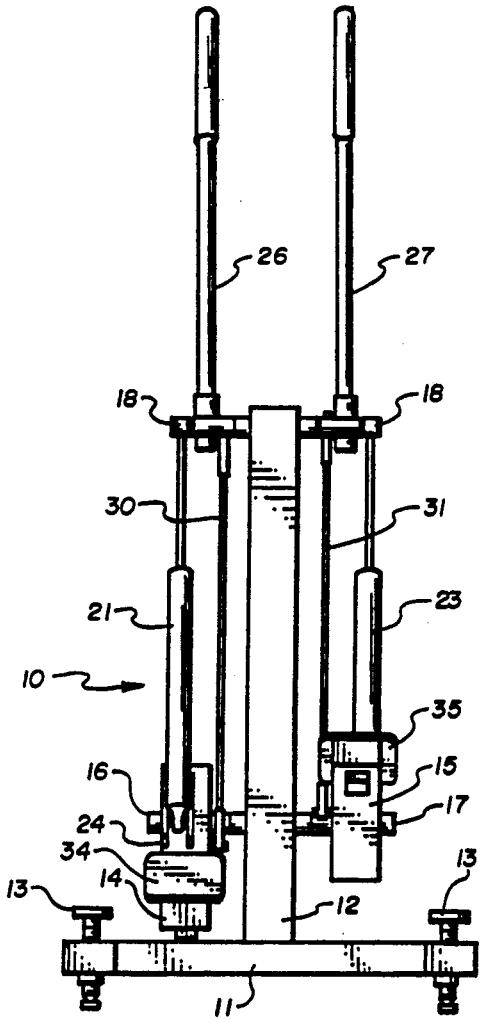
Figure 2:
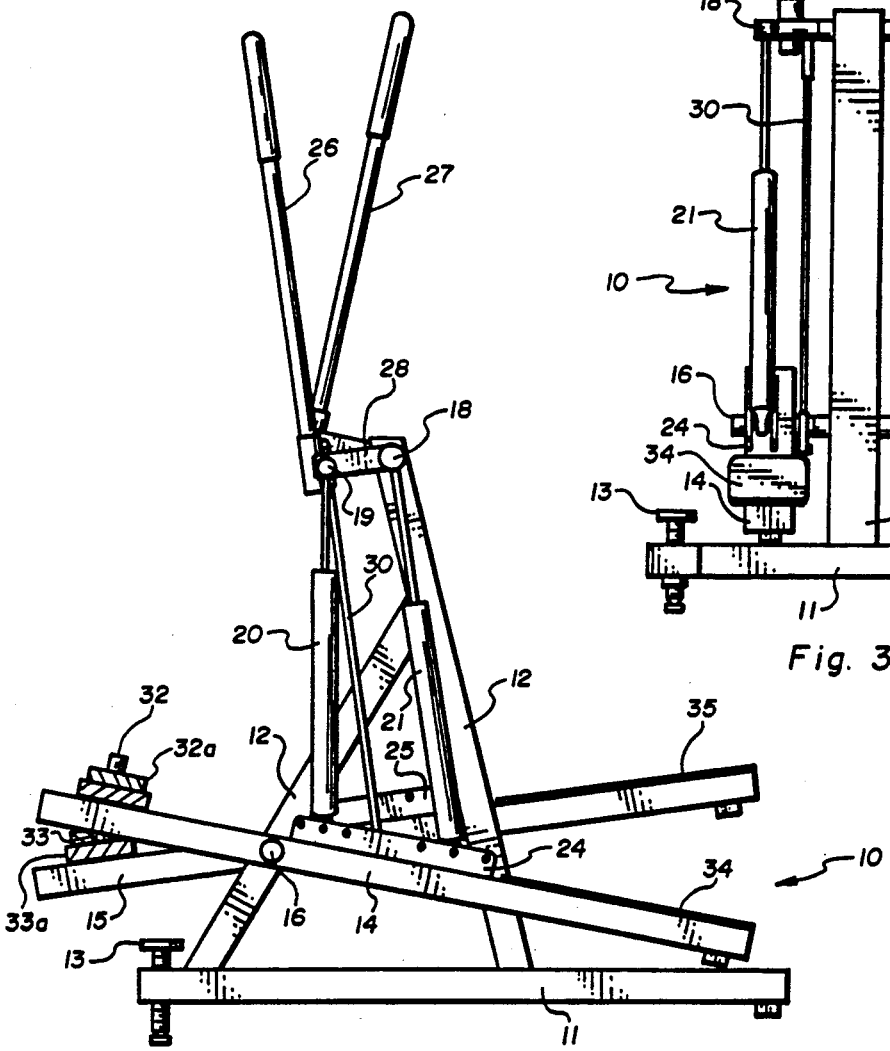

As shown in FIGS. 1, 2, and 3, an exercise apparatus 10 of the invention of has a base member 11 designed to rest on a substrate, such as a floor or the like. An adjustable support frame 12, which in this embodiment comprises a pair of struts connected at the upper ends thereof, extends upwardly from connection with the base member 11. Both base member 11 and support frame 12 are preferably constructed of metal or the like to withstand the stress of continued usage of the apparatus 10. A pair of vertically adjustable set screws 13 are attached to the rearward ends of the base member 11.

A pair of foot pedals 14, 15 are movably attached at respective ends of the pedals to the support structure 12 by means of a pair of respective rod extensions 16, 17 extending laterally outwardly from the support structure 12. Rod extensions 16, 17 are adapted to extend through apertures foot in foot pedals 14, 15 so that foot pedals 14, 15 can rotate about rod extensions 16, 17 as the foot pedals reciprocate upwardly and downwardly about the pivot points of rod extensions 16, 17.

Figure 7:
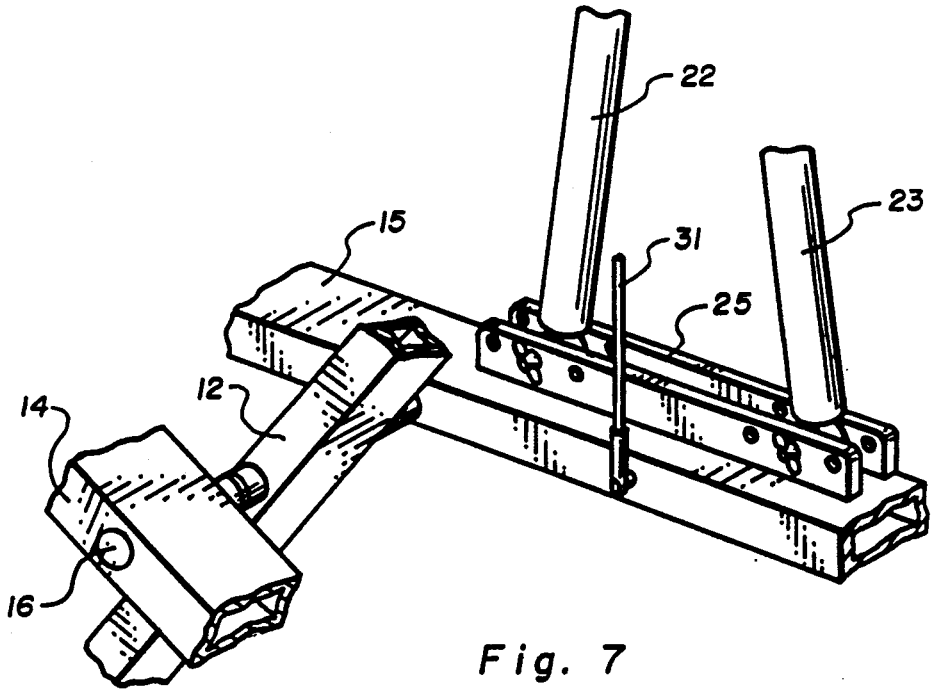

As shown in FIGS. 1, 2, 3, 4, and 5, foot pedals 14, 15 are attached respectively to a pair of laterally extending pivot posts 18, 19 attached to the upper end of support frame 12. Two pairs of adjustable compressed spring cylinders or shock absorbers 20, 21 and 22, 23 are attached at one end thereof respectively to each foot pedal 14, 15 by means of an adjustable coupling 24, 25 attached to foot pedals 14, 15 as shown in detail in FIG. 7. Adjustable couplings 24, 25 comprise in this embodiment a multiple-aperture attachment plate on each foot pedal, so that the shock absorbers 20, 21 and 22, 23 can be attached to the respective foot pedals at several locations on the foot pedal, depending on the length of the shock absorber, the resistance desired, and the desired height of the foot pedals 14, 15 above base member 11.

At the upper ends of shock absorbers 20, 21 and 22, 23, their respective upper ends are pivotally attached to laterally extending pivot rods 18, 19, for upper support of foot pedals 14, 15.

A pair of arm handles 26, 27 are fixedly attached respectively to a pair of rearward extending extension tabs 28, 29, which are rotatably attached to laterally extending pivot posts 19. The handles 26, 27 extend upwardly and are adapted to be grasped by the exerciser when using the exercise apparatus.

A pair of actuating rods, 30, 31 are pivotally attached at both ends thereof respectively to rearward extending tabs 28, 29 and to foot pedals 14, 15. Rods 30, 31 are preferably attached to foot pedals 14, 15 approximately midway within shock absorber attachment brackets 24, 25; and are designed to tie the action of foot pedals 14, 15 with that of corresponding arm handles 23, 17. As a foot pedal is lowered toward the base member, the corresponding arm handle is moved rearwardly; conversely, the movement of the arm handle forward raises the corresponding foot pedal. Accordingly, it is necessary to positively pull each arm handle forward in order to raise the corresponding foot pedal. In use, the arm handles 26, 27 are alternatively pulled forward to raise the corresponding foot pedals 14, 15. As weight is placed on each alternate foot pedal, the corresponding arm handle is moved rearwardly of the apparatus.

A furthermost important feature of the illustrated embodiment is the incorporation of upwardly extending free weight pegs 32, 33 fixedly disposed upon the upper sides of respective foot pedals 24, 25 at the rearward end thereof. Pegs 32, 33 are adapted to accommodate the placement of one or more free weights 32*a*, 33*a*, usually in the shape of metal rings, around the pegs. In this manner, a user of the apparatus can adjust the resistance to the arm and leg movement of the respective foot pedals 14, 15 and the arm handles 26, 27.

In addition, foot pads 34, 35 may be disposed upon the upper side of the forward ends of the foot pedals 14, 15. These foot pads are adopted to provide a broader foot base for each of the user's feet.

Such alternating use of each foot pedal-arm handle combination approximates the stair-climbing exercise with an accompanying arm exercise as in cross-country skiing. This combination motion of both arms and legs can be referred to as "cross-country climbing." It is not possible in this embodiment to raise a foot pedal without pulling forward on the corresponding arm handle.

Figure 4:
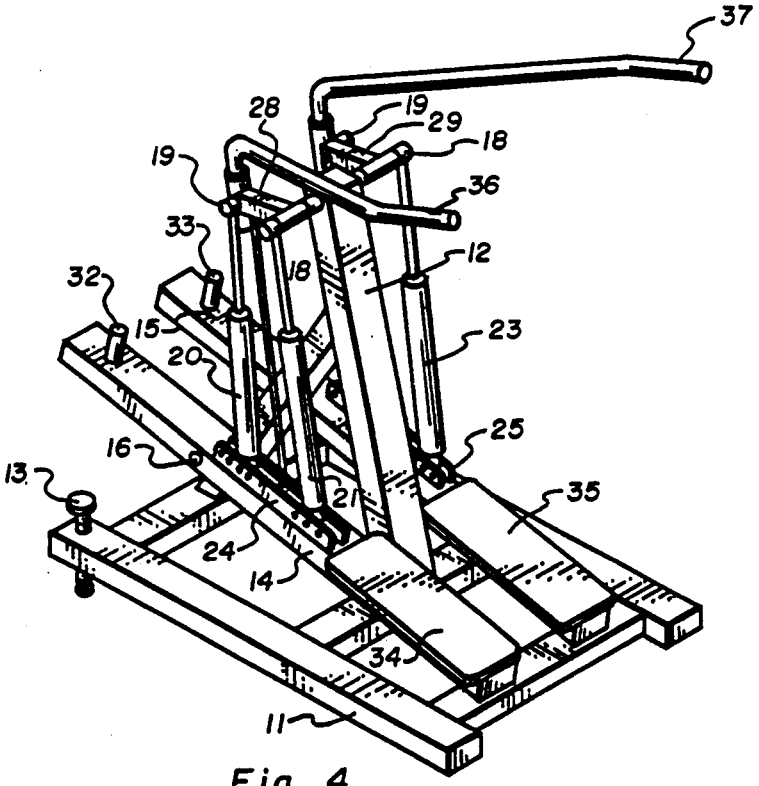

An additional alternative embodiment of this invention is illustrated in FIG. 4, wherein alternative arm handles 36, 37 are substituted for arm handles 26, 27, shown in the embodiment of FIG. 1. As shown in FIG. 4, the arm handles 36, 37 are pushed downwardly toward the floor, for a different type of exercise motion.

Figure 5:
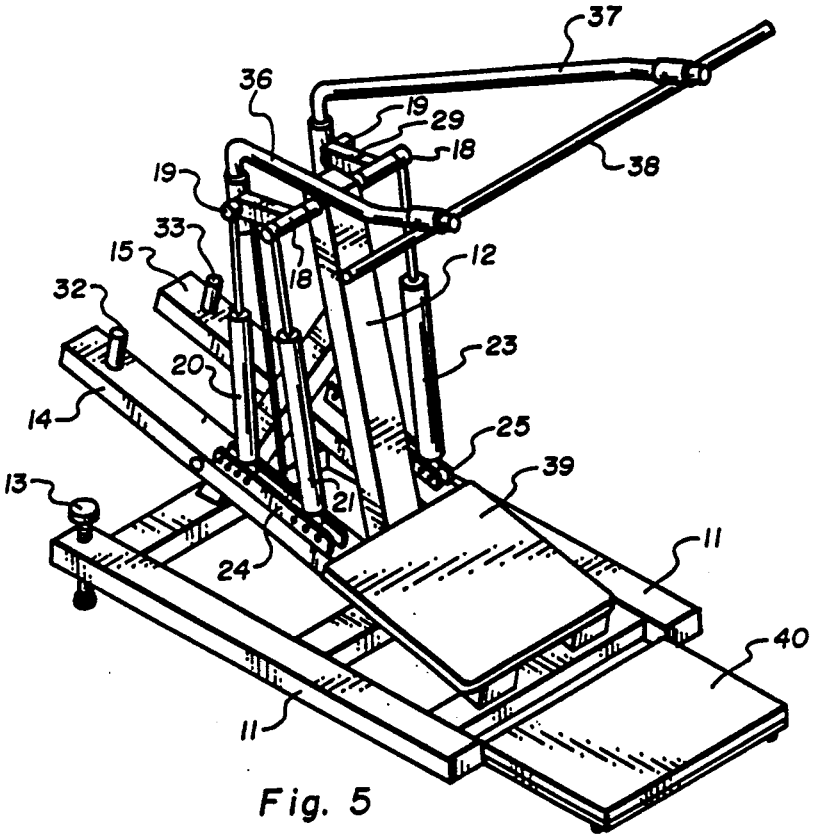

Still another embodiment is shown in FIG. 5, in which a lateral bar 38 is attached to arm handles 36, 37 of the embodiment illustrated in FIG. 4, and the separate foot pads 34, 35 or the foot pedals 14, 15, are replaced with a single pad 39; so that both foot pedals 14, 15 operate in tandem. This provides a bench press action to the exercise apparatus with the resistance provided by varying the free weights attached to the pegs 32, 33, and the resistance of the shock absorbers 20, 21, and 22, 23. A floor pad 40, as illustrated in FIG. 5, can also be attached in front of base support 11 to provide space to lie down or kneel.

Figure 6:
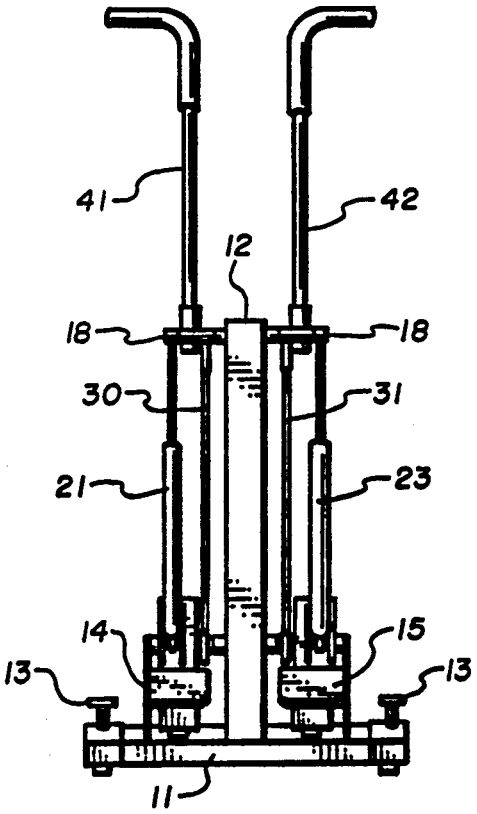

As shown in FIG. 6, outwardly angled arm handles 41, 42 can be used in place of arm handles 36, 37, to provide more of a pulling action for the user, thereby enhancing shoulder and upper arm workout.

Setting up the Apparatus for the First Set of Exercises

Place either the angled pair of handle bars or the straight pair of handle bars in position.

Warm up by walking on the stair climber 5 to 10 minutes at a medium pace.

Equipment Needed to Perform Next Three Exercises

Remove the handles used to warm up, and put in the dip bars.

Hook the floor pad in front of the base.

Lock the pedal pad onto both pedals.

1) Standing Dips

Muscles worked: Triceps, chest, and shoulder groups.

Standing firmly on the pedal pad you can face towards or away from the apparatus, (either direction is suitable for this exercise). Place hands, palms down, on top of the dip bars. Keeping back straight and knees locked, bend elbows until arms make a 90° angle, then push the bars back down until arms are fully extended. For more isolation of triceps keep elbows pointed straight back and close to your body during the exercise. For more isolation of chest, point elbows out away from your body during exercise.

Suggested reps: 4 sets of 12–15 reps., with 1–2 min. rest between each set.

2) Rowing

Muscles worked: Back, shoulders, legs, and arms.

Standing on the pedal pad facing away from the apparatus, place hands on top of the dip bars, palms down. Allow knees and waist to bend as you push the bars down past them. Quickly pull back up on the bars and simultaneously push down with your legs on the pedal pad, returning to the upright standing position with arms and legs fully extended. To work shoulders more on this exercise, add a shurgging motion as you pull the dip bars back up. Be sure to keep back straight at all times to prevent injury and to properly work back muscles.

Suggested reps: 4 sets of 12 to 15 reps., with 1-2 min. rest between each set.

3) Stomach Crunches

Muscles worked: Abdominal and shoulders.

Facing away from the apparatus sit on the pedal pad. Place hands on the dip bars just in front of your body, palms turned towards each other. Starting position is with arms fully extended up and legs extended out at a 90° angle to your body. As you pull the dip bars down, also pull knees into your chest. Then return to starting position pushing the bars back up until arms and legs are fully extended.

Suggested reps: 4 sets of 12-15 reps., with 1-2 min. rest between each set.

Equipment Needed to Perform Next Eleven Exercises

Leave dip bars, pedal pad and floor pad in place. Add the bench press bar to the dip bars and secure.

1) Standing Calf Raise

Muscles worked: Calves,

Place a block that is at least two inches thick on the floor pad. Stand on the block with your heels hanging over the edge of it, facing the apparatus. Work your calves by raising up to your toes, then pressing your heels back down to the floor pad. For more intensity, grasp the bench press bar and perform the same movement as above holding the bar as you raise and lower your heels. Be sure to keep your back straight, knees locked, and when using the bar, lock elbows. This will prevent any injury to your back.

Suggested reps: 4 sets of 20-30 reps with a 1-2 min. rest between reps.

2) Standing Leg Curl

Muscles worked: Hams and buttocks.

Standing facing the apparatus inside the bench press bar, on the floor pad. Hook lower back of leg under the bench press bar. Bend at the waist, keeping back straight, place hands on the main body of the apparatus for support. Lift the bench press bar in an upward motion toward buttocks, then switch to other leg and repeat motion.

Suggested reps: 4 sets of 12-15 reps

3) Squats

Muscles worked: Quads, calves, buttocks, hamstring.

Stand with your back to the apparatus. Place feet on floor pad and bench press bar across shoulders and lower back of neck. Place hands on the outside edges of bar, palms forward. Keeping back straight and head level. Bend at the knees until the pedal pad touches buttocks or legs at a 90° angle. Return to standing position to complete first rep. To work buttocks, concentrate on squeezing buttocks together as you return to the standing position. Be sure to keep heels firmly on the floor pad.

Suggested reps: 4 sets of 15-20 reps.

4) Lat Pull Downs

Muscles worked: Back, shoulders, arms, obliques, and stomach. Facing away from the apparatus sit down on the pedal pad, placing hands at a wide, but comfortable distance on the bench press bar, palms forward. Feet can be rested on the floor pad or for a more intense workout, extend legs to a 90° angle with your body, keeping your knees locked. Pull the bench press bar down past your chin to your chest, then slowly allow the bar to return to up position with arms fully extended.

Suggested reps: 4 sets of 12-15 reps

5) Straight Arm Pull Down

Muscles worked: Back, Shoulders, Arms, Stomach.

Facing away from the apparatus and sitting on the pedal pad, place hands together, palms forward on the bench press bar. (Be sure thumbs are on top of the bar). Feet can be rested on floor pad or extended out to a 90° angle to your body for a more intense workout. With arms straight and elbows locked pull the bar down towards knees as far as possible then slowly allow bar to return to up position with arms fully extended.

Suggested reps: 4 sets 12-15 reps

6) Bench Press

Muscles worked: Chest, Tri's, Shoulders.

Facing away from the apparatus, and standing on the pedal pad, place hands at a wide, but comfortable distance on bar, palms down. Bend to a 90° angle at the waist. Keeping back straight and knees locked, press bar towards the floor, then allow the bar to slowly raise up until it touches your chest. Be sure not to change the angle of your body by raising up with the bar.

Suggested reps: 15-20 reps

7) Military Press

Muscles Worked: Shoulders, arms.

Facing the machine and kneeling on the floor pad, place hands at a wide, comfortable distance on bench press bar, palms forward. Pull the bar down to chest, then press the bar to return it to up position with arms fully extended. For further development of your shoulder muscles pull bar down behind your head to back of neck every other rep.

Suggested reps: 12-15 reps

8) Shrugs

Muscles worked: Traps.

Stand on the floor pad facing the apparatus. Place hands, palms down, shoulder width apart on the bench press bar. Keeping arms straight and elbows locked, lift shoulders, continue to roll shoulders in a circular motion. When shoulders are back to down position, first rep is completed.

Suggested reps: 4 sets of 20-30

9) Wrist Curls

Muscles Worked: Forearms.

Stand on floor pad facing the apparatus. Place hands at a close, but comfortable position on the bar, palms up. With arms straight and elbows locked, roll bar up using wrists only to lift. Be sure to stand with back straight.

Suggested reps: 4 sets of 12-15 reps

10) Arm Extensions

Muscles worked: Triceps and forearms.

(Can be performed two different ways).

A) Kneel on floor pad facing the apparatus. Place hands as close together as possible, palms forward and thumbs next to fingers on the bar. With head tilted slightly forward and elbows facing straight forward, press the bench press bar from back of neck up. Be sure not to move shoulders in this exercise, extend arms from the elbows only. Keep back straight.

Suggested reps: 4 sets of 12–15

B) Stand on pedal pad facing the apparatus. Place hands as close together as possible on the bench press bar behind your back, (thumbs on top of bar). With elbows facing back, pull the bar up towards the center of your back, then push the bar down past your waist. Bend only your elbows when pulling up and pushing down. Keep back straight.

Suggested reps: 4 sets of 12–15

11) Curls

Muscles worked: Biceps and forearms.

(Can be performed two different ways).

A) Kneel on floor pad facing apparatus. Place hands about shoulder width distance, palms up, and turned towards yourself on the bar. Pull the bar down under your chin to your chest, then push the bar back up until arms are fully extended.

B) Facing away from the apparatus sit on the pedal pad. Place hands close together, palms up, and turned towards yourself on the bar. Pull the bar down under chin to chest, then push bar back up until arms are fully extended. For added intensity, extend legs out at a 90° angle.

Suggested reps: 4 sets of 12–15

While this invention has been described with reference to preferred embodiments illustrated in the accompanying drawings and described in the attached claims, it is intended that substantial equivalents apparent to those skilled in the art are included within the scope of this invention.

We claim:

1. A full body exercise apparatus, comprising in combination:

a horizontal base member;

an upright support frame attached at its lower end to said base member;

a pair of elongate foot pedals pivotally attached approximately midway thereof respectively to said support frame;

a pair of support pegs for free weights disposed on the upper side of said food pedals at the rearward ends thereof;

a cross member attached to the upper end of said support frame;

a pair of elongate, straight arm handles pivotally attached to said cross member;

a pair of actuating rods pivotally attached at one end thereof respectively to said arm handles and at the other end respectively to said foot pedals, and;

two pair of elongate tensioning means pivotally attached at one end thereof to said cross member and at the other end thereof respectively to each of said foot pedals.

2. An exercise apparatus as set forth in claim 1, wherein the tensioning means is a shock absorber.

3. An exercise apparatus as set forth in claim 1, wherein said pair of elongate foot pedals are attached together at the ends opposite to ends thereof having said support pegs attached thereto.

4. An exercise apparatus as set forth in claim 1, wherein said elongate straight arm handles are replaced with a pair of laterally outward extending arm handles.

5. An exercise apparatus as set forth in claim 1, wherein said elongate straight arm handles are replaced with a pair of forwardly extending lateral arm handles.

6. An exercise apparatus as set forth in claim 5, including a laterally extending bar connecting the pair of forwardly extending lateral bar handles.

7. An exercise apparatus as set forth in claim 1, including a foot pad extending forwardly of the base member for resting on the floor.

8. An exercise apparatus as set forth in claim 1, including at least one free weight disposed about each of the pair of support pegs.

* * * * *